US008230837B2

(12) United States Patent
Hergert et al.

(10) Patent No.: US 8,230,837 B2
(45) Date of Patent: Jul. 31, 2012

(54) VALVE DRIVE TRAIN ACTUATING DEVICE

(75) Inventors: Marcus Hergert, Böblingen (DE); Kai Kanning, Stuttgart (DE); Stefan Rudert, Langenargen (DE)

(73) Assignee: Daimler AG, Stuttgart (DE)

( * ) Notice: Subject to any disclaimer, the term of this patent is extended or adjusted under 35 U.S.C. 154(b) by 265 days.

(21) Appl. No.: 12/658,585

(22) Filed: Feb. 8, 2010

(65) Prior Publication Data

US 2010/0180860 A1 Jul. 22, 2010

Related U.S. Application Data

(63) Continuation-in-part of application No. PCT/EP2008/006487, filed on Aug. 7, 2008.

(30) Foreign Application Priority Data

Aug. 11, 2007 (DE) ..... 10 2007 038 078

(51) Int. Cl.
*F02D 13/04* (2006.01)

(52) U.S. Cl. ..... 123/321; 123/90.17

(58) Field of Classification Search ..... 123/90.12, 123/90.16, 90.17, 90.39, 90.4, 90.57, 321, 123/182.1, 345–348
See application file for complete search history.

(56) References Cited

U.S. PATENT DOCUMENTS

| | | | | |
|---|---|---|---|---|
| 6,244,257 | B1 | 6/2001 | Hu | |
| 6,386,160 | B1 * | 5/2002 | Meneely et al. | 123/90.16 |
| 6,422,186 | B1 * | 7/2002 | Vanderpoel | 123/90.15 |
| 6,510,824 | B2 * | 1/2003 | Vorih et al. | 123/90.12 |
| 6,925,976 | B2 * | 8/2005 | Israel et al. | 123/90.12 |
| 7,252,054 | B2 * | 8/2007 | Weber et al. | 123/90.15 |
| 7,464,675 | B1 * | 12/2008 | Schechter | 123/90.15 |
| 2002/0104509 | A1 | 8/2002 | Bhargava et al. | |

FOREIGN PATENT DOCUMENTS

| | | |
|---|---|---|
| DE | 195 26 463 | 1/1997 |
| GB | 112 644 | 1/1918 |
| WO | WO 00/61930 | 10/2000 |

* cited by examiner

*Primary Examiner* — Hai Huynh
(74) *Attorney, Agent, or Firm* — Klaus J. Bach

(57) ABSTRACT

In a valve drive train actuating device, particularly for an internal combustion engine, having at least one firing camshaft, which can be phase shifted relative to a crankshaft by a firing camshaft adjusting device and a decompression brake device comprising at least one brake cam and at least one decompression valve, the valve drive train actuating device comprises an adjusting device for adjusting a decompression valve drive actuating point in time depending on the speed of the crankshaft of the engine such that, with decreasing speed of the crankshaft, the brake cam actuating point is moved toward the upper dead center position of the crankshaft.

7 Claims, 2 Drawing Sheets

VALVE DRIVE TRAIN ACTUATING DEVICE

This is a Continuation-in-Part application of pending international patent application PCT/EP2008/006487 filed Aug. 7, 2008 and claiming the priority of German patent application 10 2007 038 078.1 filed Aug. 11, 2007.

BACKGROUND OF THE INVENTION

The invention relates to a valve drive train actuating device having at least one firing camshaft, which can be phase shifted relative to a crankshaft by means of a firing camshaft adjusting device and a decompression brake device comprising at least one brake cam and at least one decompression valve.

Valve drive train actuating devices, particularly for internal combustion engines having at least one firing camshaft, which can be phase-shifted with respect to a crank-shaft by means of a firing camshaft adjusting device, which has also a decompression brake device comprising at least one braking cam and at least one decompression valve, are already known.

It is the principal object of the present invention to provide a decompression brake device with a maximum braking performance in different engine operating states.

SUMMARY OF THE INVENTION

In a valve drive train actuating device, particularly for an internal combustion engine, having at least one firing camshaft, which can be phase shifted relative to a crankshaft by means of a firing camshaft adjusting device and a decompression brake device comprising at least one brake cam and at least one decompression valve, the valve drive train actuating device comprises an adjusting device for adjusting a decompression valve drive actuating point in time depending on the speed of the crankshaft of the engine.

Preferably, the valve drive train actuating device comprises an adjusting device for adjusting a decompression valve drive train operating point in time. A "decompression valve drive train actuating point in time" is a point in time related to the crankshaft, particularly a phase point of time related to the crankshaft, at which the decompression valve drive train is actuated by the decompression brake device and particularly opened. The decompression valve drive train can be in the form of a one piece or multi-piece gas outlet valve. "Provided" is intended to mean to be specifically equipped, designed and/or programmed. A decompression brake device with a maximum brake performance can be provided in a simple manner in different operating states by having an adjustable valve drive train actuating point in time.

It is further suggested that the brake cam is arranged on the firing camshaft. A decompression brake device with an adjustable valve drive train actuating point of time can be provided thereby, which can be produced in a particular simple and economic manner. An arrangement of the brake cam on a separate brake camshaft is however also conceivable in principle.

If the adjusting device is further provided to adjust a phase shift between the crankshaft and the firing camshaft, the decompression valve drive train actuating point in time, where the brake cam arranged on the firing camshaft actuates the decompression valve drive train, can be adjusted in a particularly simple manner.

It is further advantageous if the adjusting device is an at least partially integral part of the firing camshaft adjusting device. Material, components and costs can be saved thereby, and the decompression brake device can be designed in an especially compact manner.

Further, a control unit is suggested, which is provided to adjust the decompression valve drive train actuating point of time. The decompression brake device can be adapted to different operating states in an particularly flexible manner by means of a control unit.

The control unit is advantageously provided to adjust the decompression valve drive train actuating point of time in dependence on a speed of the crankshaft. A brake performance adapted to the operating state can be adjusted thereby. A cylinder pressure which is too high can particularly be avoided by an adjustment in dependence on the speed of the crankshaft, which particularly corresponds to a speed of an internal combustion engine. An adjustment in dependence on further or alternative parameters which appear sensible to the expert are also possible in principle, as for example in dependence on a load state or a driver command.

If the adjustment takes place depending on a speed of the crankshaft, it is especially preferred if, with a decreasing engine speed, the brake camshaft actuating point of time is displaced in the direction of an upper dead center position. An "upper dead center position" is a position of the crankshaft, where the movement direction of a piston connected to the crankshaft is changed or a position of the piston, where a compression of a gas enclosed in a cylinder by the piston is maximal. By such an adjustment, a maximum brake torque can also be provided in a low speed operating state of the engine.

The invention will become more readily apparent from the following description of a particular embodiment on the basis of the accompanying drawings.

BRIEF DESCRIPTION OF THE DRAWINGS

It is shown in.

DETAILED DESCRIPTION OF A PREFERRED EMBODIMENT

Figure 1:
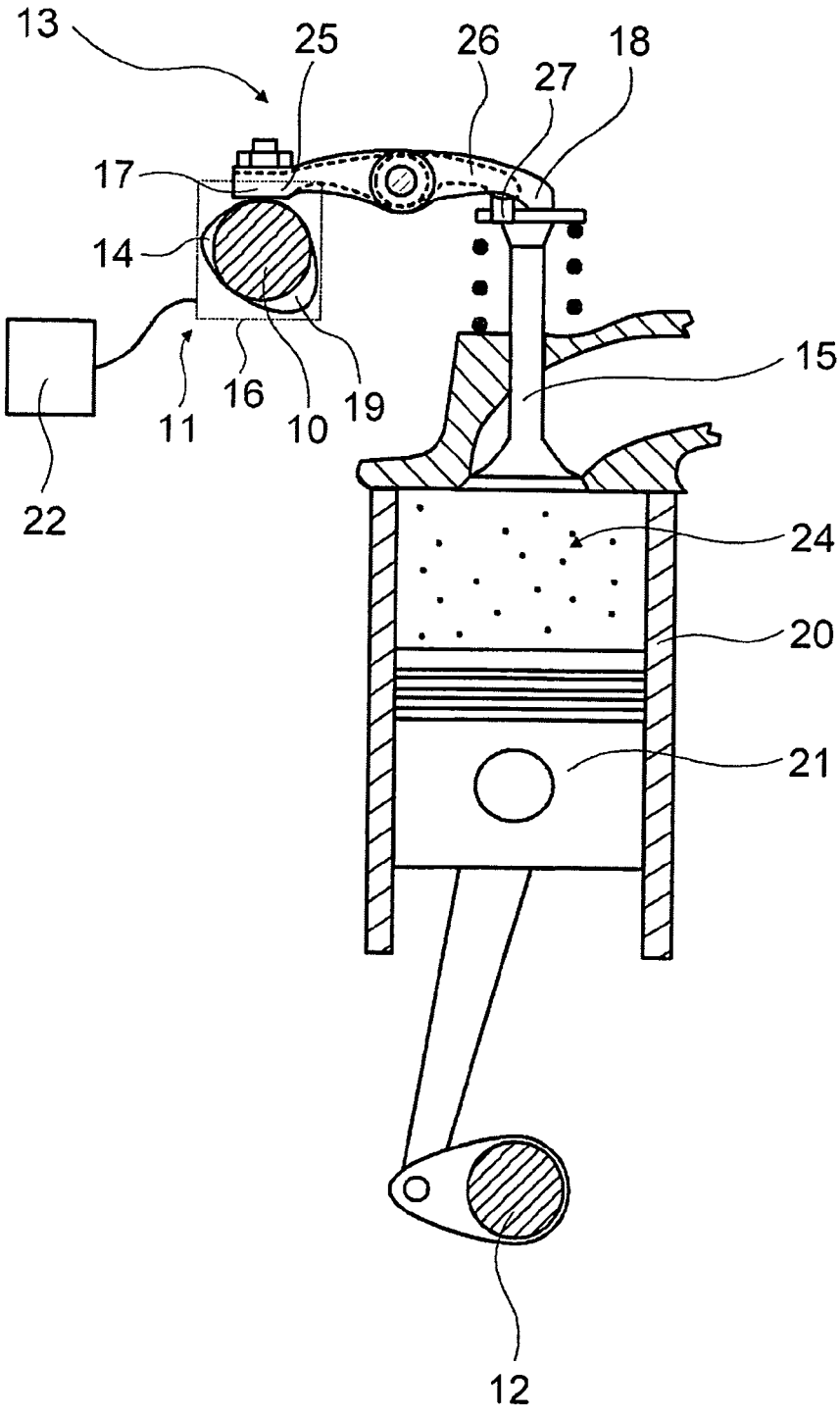
FIG. 1 a valve drive train actuating device in a closed state.

FIG. 1 shows in cross section an engine cylinder with a valve drive train actuating device for an internal combustion engine having a firing camshaft 10, which can be phase-shifted relative to a crankshaft 12 by means of a firing camshaft adjusting device 11. A decompression brake drive 13 is arranged in the valve drive train actuating device, which brake device comprises a brake cam 14 and a decompression valve 15. So as to be able to achieve a maximum brake performance, the valve drive train actuating device comprises an adjusting device 16, by means of which a decompression valve drive train actuating point in time, at which the decompression valve drive 13 is opened, can be adjusted.

Figure 2:
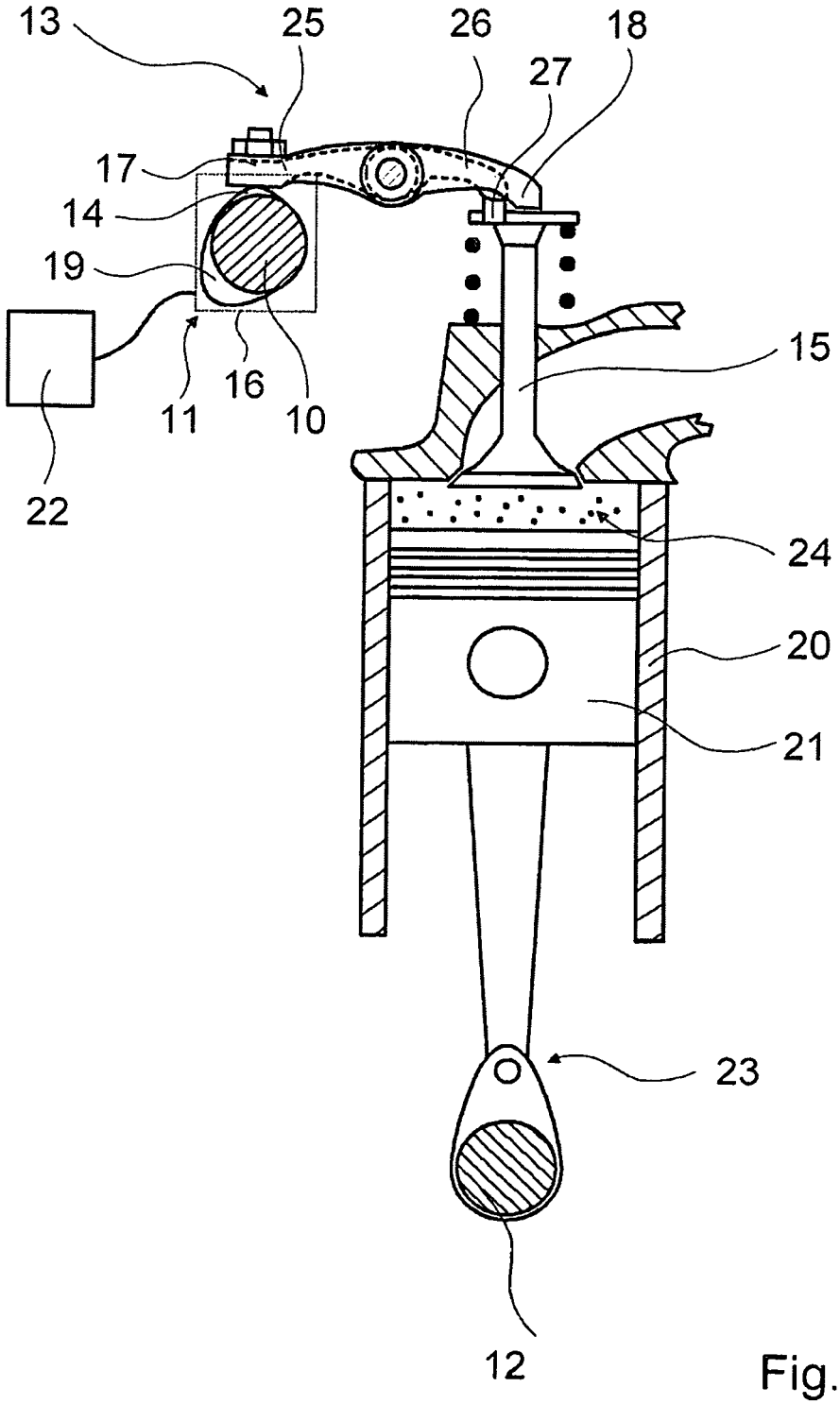
FIG. 2 a valve drive train actuating device in an opened state at an upper dead center of a crankshaft.

The brake cam 14 of the decompression brake drive 13 is arranged on the firing camshaft 10. The brake cam 14 is connected to the brake rocker lever 18 via a brake cam follower 17, which is arranged at a brake rocker lever 18. The brake cam follower 17 follows the movement of the brake cam 14, whereby the brake rocker lever 18 performs a pivoting movement. In a brake operation, in which the decompression valve drive 13 is activated, the brake rocker lever 18 is connected to the decompression valve 15 via a suitable device 27, and the decompression valve 15 is opened by the pivoting movement of the brake rocker lever 18 (FIG. 2).

The decompression valve 15, which at the same time forms an exhaust gas outlet valve during firing operation, is connected to an exhaust cam 19 via a further rocker lever 26. The rocker lever 26 follows the movements of the exhaust cam 19 via a cam follower 25. In an engine firing operation, the decompression valve 15, which then forms the exhaust gas outlet valve, is opened by the exhaust cam 19 and the rocker lever 26.

The adjusting device 16, which adjusts the exhaust gas outlet valve drive actuating point in time, is advantageously integrally formed with the firing camshaft adjusting device 11, as the brake cam 14 is arranged on the firing camshaft 10.

During the braking operation, the gas 24 enclosed in a cylinder 20 is compressed by a movement of a piston 21 against a pressure being built up in the cylinder 20. A maximum built-up pressure of the gas 24 enclosed in the cylinder 20, which is reached when the decompression valve 15 remains closed, increases particularly with an increasing speed of the crankshaft 12. The speed of the crankshaft 12 corresponds to the speed of the internal combustion engine. An energy which is expended for compression of the gas 24, particularly depends on the pressure built up in the cylinder 20. The expended energy is discarded particularly as a heat energy by the opening of the decompression valve 15 resulting in a brake action.

A decompression valve drive train actuating point of time for opening the decompression valve 15 is adjusted by means of a control unit 22 via an adjustment of the phase angle between the crankshaft 12 and the firing camshaft 10. The pressure built up in the cylinder 20 should never exceed a maximum permissible cylinder pressure. The firing camshaft 10 is rotated by the crankshaft 17 via the adjusting device 16 which adjusts the phase angle of the camshaft relative to the crankshaft.

The pressure in the cylinder 20 is built up faster at a high engine speed than at a low speed. As the built-up pressure is larger with a high speed than with a low speed, the pressure built up in the cylinder 20 may exceed the maximum permissible cylinder pressure particularly at a high speed. To avoid this, the decompression valve 15 is opened before the piston reaches the upper dead center position 23, particularly during high speed engine operation.

At a low engine speed, the pressure in the cylinder 20 is built up slowly and the maximum permissible cylinder pressure sure is lower and is reached later. So as to achieve a maximum brake performance, the control unit 22 displaces the decompression valve drive actuating point of time at lower engine speed in the direction toward the upper dead center position 23. With a very low speed, the maximum built-up pressure of the gas 24 enclosed in the cylinder 20 remains generally below the maximum permissible cylinder pressure. The decompression valve 15 is then opened at the upper dead center position 23 of the piston where the pressure built up in the cylinder 20 reaches a maximum, and a maximum brake performance can be achieved. The decompression valve 15 can in principle also be opened at an earlier point of time, if a lower brake performance is sufficient.

What is claimed is:

1. A valve drive train actuating device for an internal combustion engine having at least one firing camshaft (10), including a firing camshaft adjusting device (11) for phase-shifting the firing camshaft (10) in relation to a crankshaft (12) driving the firing camshaft (10), a decompression brake device (13) comprising at least one brake cam (14) and at least one decompression valve (15) with a decompression valve drive for engine braking operation, and an adjusting device (16) for adjusting the decompression valve drive for controlling an actuating point of time of the decompression valve (15) in such a way that, with a decreasing speed of the crankshaft (12), the brake cam actuating point of time is displaced in the direction toward an upper dead center position (23) of the crankshaft.

2. The valve drive train actuating device according to claim 1, wherein the brake cam (14) is arranged on the firing camshaft (10).

3. The valve drive train actuating device according to claim 2, wherein the adjusting device (16) is arranged on the firing camshaft (10) for adjusting a phase shift between the crankshaft (12) and the firing camshaft (10).

4. The valve drive train actuating device according to claim 1, wherein the adjusting device (16) is formed at least partially integrally with the firing camshaft adjusting device (11).

5. The valve drive train actuating device according to claim 1, wherein a control unit (22) is provided to adjust the decompression valve drive actuating point in time.

6. The valve drive train actuating device according to claim 5, wherein the control unit (22) is provided to adjust the decompression valve drive actuating point in time depending on a speed of the crankshaft (12).

7. A method for operating a valve drive train actuating device, for an internal combustion engine, having at least one firing camshaft (10), which can be phase-shifted with respect to a crankshaft (12) by means of a firing camshaft adjusting device (11), and a decompression brake device (13) for engine braking operation comprising at least one brake cam (14) and at least one decompression valve (15), said method comprising the step of adjusting the valve drive train actuating point of time during engine braking operation in dependence on a speed of the crankshaft (12) in such a way that, with a decreasing speed of the crankshaft (12), the brake cam actuating point of time is displaced in the direction toward an upper dead center position (23) of the crankshaft.

* * * * *